US005660564A

United States Patent [19]

Yamanashi et al.

[11] Patent Number: 5,660,564

[45] Date of Patent: Aug. 26, 1997

[54] CONNECTOR MOUNTING ARRANGEMENT FOR MOUNTING CONNECTOR ON PANEL

[75] Inventors: Makoto Yamanashi; Masahiro Sawayanagi, both of Shizuoka-ken, Japan

[73] Assignee: Yazaki Corporation, Tokyo, Japan

[21] Appl. No.: 643,922

[22] Filed: May 7, 1996

[30] Foreign Application Priority Data

May 8, 1995 [JP] Japan ..... 7-109542

[51] Int. Cl.[6] ..... H01R 13/74

[52] U.S. Cl. ..... 439/557; 439/556; 439/563

[58] Field of Search ..... 439/557, 556, 439/563, 559, 550, 544

[56] References Cited

U.S. PATENT DOCUMENTS 3,753,212 8/1973 Yamada et al. ..... 439/557
5,238,426 8/1993 Arnett ..... 439/557
5,249,982 10/1993 Funck et al. ..... 439/557
5,277,623 1/1994 Colleran et al. ..... 439/557

FOREIGN PATENT DOCUMENTS 55-44317 10/1980 Japan .

OTHER PUBLICATIONS

IBM Technical Disclosure Bulletin, "Panel and Card Mounting Adapter for Universal Planar Connector", vol. 28, No. 11, Apr. 1986.

*Primary Examiner*—Gary F. Paumen
*Attorney, Agent, or Firm*—Finnegan, Henderson, Farabow, Garrett & Dunner, L.L.P.

[57] ABSTRACT

A mounting arrangement is used for mounting a connector in a mounting hole formed in a panel. The mounting arrangment comprises an adapter which is mounted on the outer periphery of a housing of the connector so that the connector can be mounted in a large-diameter mounting hole of a greater diameter than that of the mounting hole sized to the housing when the size of the mounting hole is changed to the greater diameter.

10 Claims, 6 Drawing Sheets

CONNECTOR MOUNTING ARRANGEMENT FOR MOUNTING CONNECTOR ON PANEL

BACKGROUND OF THE INVENTION

1. Field of the Invention

The present invention relates generally to a connector mounting arrangement for mounting a connector on a panel. More specifically, the invention relates to a connector mounting arrangement which is suitable for mounting a connector on a panel, such as a vehicular body panel, so that the connector is received in a mounting hole formed in the panel for connecting a wire harness arranged on the side of a vehicular body to another wire harness on the side of a vehicular door.

2. Description of the Prior Art

Conventionally, various types of connector mounting arrangments for mounting a connector on a vehicular door panel for connecting a wire harness on the side of a vehicular body to another wire harness on the side of a vehicular door have been proposed. In one of such connector mounting arrangements, one end of a wire harness extending between a vehicular body panel and a door panel is drawn out of the door panel to be connected to a panel-mounted type connector so that the wire harness is connected, by means of a connector, to another wire harness arranged inside of the vehiclar body panel.

This connector comprises a housing of elliptic cross section, a flange portion formed on the outer periphery of one end of the housing for contacting the edge portion of a mounting hole formed in the vehicular body panel, and a resilient engaging portion which projects from the housing to be associated with the flange for holding the edge portion of the mounting hole. On the opposite side to the flange portion, the connector has a hood portion for engaging another connector mounted at the end of the another wire harness. In addition, one end of a waterproof grommet is held between the flange portion and the edge portion of the mounting hole.

Such a panel-mounted type connector is also disclosed in Japanese Utility Model Publication No. 55-44317. This connector comprises a housing for receiving therein a plurality of terminal fittings, a flange portion, a resilient engaging portion and a hood portion. One end of a waterproof grommet is held between the flange portion and the edge portion of a mounting hole formed in a panel, so as to prevent the entrance of water through the mounting hole.

By the way, the size of the mounting hole formed in the pannel may be changed. In such a case, if the connector is mounted in a mounting hole of a greater diameter than that of the mounting hole sized to the housing, the gap between the resilient engaging portion and the flange portion is increased. As a result, it is impossible to surely hold the one end of the waterproof grommet, so that the water-resistance is reduced. Therefore, it is required to manufacture new connectors sized to the changed mounting hole.

However, if such new connectors are used, the connectors sized to the previous mounting hole remain as useless stock items so as to come to nothing.

SUMMARY OF THE INVENTION

It is therefore an object of the present invention to eliminate the aforementioned problems and to provide a connector mounting arrangement which is suitable for mounting a connector in a mounting hole formed in a panel even if the size of the mounting hole sized to the connector is changed.

In order to accomplish the aforementioned and other objects, according to one aspect of the present invention, there is provided a mounting arrangement for mounting a connector on a panel, the connector having a housing capable of being received in a mounting hole which is formed in a panel and which is sized to the housing, a flange portion provided on the outer periphery of one end portion of the housing so as to be capable of facing an edge portion surrounding the mounting hole, a resilient engaging portion projecting from the outer periphery of the housing so as to be capable of being associated with the flange portion for being engageable with an opening edge portion of the mounting hole, and a waterproof grommet, one end of which is capable of being held between the flange portion and the edge portion so as to seal the portion between the frange portion and the edge portion, the mounting arrangement comprising an adapter mounted on the outer periphery of the housing for mounting the connector in a large-diameter mounting hole of a greater diameter than that of the mounting hole sized to the housing. According to this aspect of the present invention, in order to mount the connector in the large-diameter mounting hole of a greater diameter than that of the mounting hole sized to the housing, the adapter is mounted on the outer periphery of the housing to increase the diameter of the outer periphery of the housing, and the connector, together with the adapter, is inserted into the large-diameter mounting hole. Then, the connector is mounted in the large-diameter mounting hole while the one end of the waterproof grommet is held between the flange portion and the edge portion of the large-diameter mounting hole. In addition, it is possible to mount the connector in the original mounting hole sized to the housing by removing the adapter from the outer periphery of the housing. Therefore, even if the size of the mounting hole is changed, it is possible to mount the connector of the same type as that of the connector sized to the mounting hole, on the panel by providing the adapter which is mounted on the outer periphery of the housing so that the housing can be mounted in the large-diameter mounting hole of a greater diameter than the mounting hole sized to the housing. Accordingly, it is possible to prevent the connectors of the same type as that of the connectors sized to the previous mounting hole, from remaining as useless stock items to make good use of the connectors.

The adapter may comprise a cylindrical adapter body, an engaging and mounting portion provided on the inner surface of the adapter body for engaging the resilient engaging portion to mount the adapter on the housing, and a panel engaging portion provided on the outer surface of the adapter body for engaging an opening edge portion of the large-diameter mounting hole, the panel engaging portion being associated with the flange portion for holding the opening edge portion of the large-diameter mounting hole and the one end of the waterproof grommet. In this case, the adapter is mounted on the outer periphery of the housing by arranging the cylindrical adapter body on the housing and by engaging the engaging and mounting portion provided on the inner surface of the adapter with the resilient engaging portion projecting from the outer periphery of the housing. In addition, the connector is mounted in the large-diameter mounting hole by inserting the housing, together with the adapter, into the large-diameter mounting hole and by engaging the panel engaging portion with the opening edge portion of the large-diameter mounting hole so as to be associated with the flange portion to hold the opening edge portion of the large-diameter mounting hole. Therefore, it is possible to mount the adapter on the outer periphery of the housing by arranging the cylindrical adapter body on the housing to engage the engaging and mounting portion provided on the inner surface of the adapter with the resilient engaging portion projecting from the outer periphery of the housing, and it is possible to mount the connector in the large-diameter hole by inserting the adapter, together with the housing, into the large-diameter mounting hole. Accordingly, even if the size of the mounting hole is changed, the connectors of the same type as that of the previous connectors on the panel.

The panel engaging portion may be so arranged as to be offset from the engaging and mounting portion in the circumferential direction of the housing. In this case, the position in which the engaging and mounting portion of the adapter mounted on the housing engages the resilient engaging portion is affset from the position in which the panel engaging portion engages the opening edge portion of the mounting hole, in the circumferential direction of the housing. Therefore, it is possible to surely mount the adapter on the outer periphery of the housing by offsetting the panel engaging portion from the engaging and mounting portion in the circumferential direction of the housing.

The adapter body may comprise a pair of substantially U-shaped adapter half-bodies, the open ends of one of the adapter half-bodies facing the open ends of the other adapter half-body to be united with each other so as to form the cylindrical adapter body. In this case, the open ends of one of the two adapter half-bodies is so arranged as to face the open ends of the other adapter half-body, and the one adapter half-body is united with the other adapter half-body so as to hold the housing therebetween, so that the adapter is mounted on the outer periphery of the connector, to the end of which a wire harness is connected.

In this mounting arrangment, one end of each of the adapter half-bodies may be formed with an engaging projection, and the other end thereof may be formed with an engaging portion so that the engaging portion of one of the adapter half-bodies is engageable with the engaging projection of the other adapter half-body. In this case, the open ends of one of the adapter half-bodies is so arranged as to face the open ends of the other adapter half-body, so that the engaging projection formed on the one adapter half-body is engaged with the engaging portion formed on the other adapter half-body, and the engaging portion formed on the one adapter half-body is engaged with the engaging projection formed on the other adapter half-body. In this way, the adapter is mounted on the outer periphery of the housing. Therefore, it is possible to easily unite the adapter half-bodies with each other and mount them on the outer periphery of the housing of the connector, by forming the engaging projections on one ends of the adapter half-bodies and the engaging portions on the other ends of the adapter half-bodies so that the engaging portions can engage the corresponding engaging projections.

According to another aspect of the present invention, there is provided a connecting apparatus mounted on a panel for connecting a wire harness to another wire harness, the connecting apparatus comprising: a connector having a housing capable of being received in a mounting hole which is formed in a panel and which is sized to the housing, a flange portion provided on the outer periphery of one end portion of the housing so as to be capable of facing an edge portion surrounding the mounting hole, and a resilient engaging portion projecting from the outer periphery of the housing so as to be capable of being associated with the flange portion for being engageable with an opening edge surrounding portion of the mounting hole; a waterproof grommet, one end of which is capable of being held between the flange portion and the edge portion so as to seal the portion between the frange portion and the edge portion; and an adapter mounted on the outer periphery of the housing for mounting the connector in a large-diameter mounting hole of a greater diameter than that of the mounting hole sized to the housing.

Similar to the aforementioned one aspect of the present invention, the adapter may comprise a cylindrical adapter body, an engaging and mounting portion provided on the inner surface of the adapter body for engaging the resilient engaging portion to mount the adapter on the housing, and a panel engaging portion provided on the outer surface of the adapter body for engaging an opening edge portion of the large-diameter mounting hole, the panel engaging portion being associated with the flange portion for holding the opening edge portion of the large-diameter mounting hole and the one end of the waterproof grommet. The panel engaging portion may be so arranged as to be offset from the engaging and mounting portion in the circumferential direction of the housing. The adapter body may comprise a pair of substantially U-shaped adapter half-bodies, the open ends of one of the adapter half-bodies facing the open ends of the other adapter half-body to be united with each other so as to form the cylindrical adapter body. In this connecting apparatus, one end of each of the adapter half-bodies may be formed with an engaging projection, and the other end thereof may be formed with an engaging portion so that the engaging portion of one of the adapter half-bodies is engageable with the engaging projection of the other adapter half-body.

DESCRIPTION OF THE PREFERRED EMBODIMENT

Referring now to the accompanying drawings, the preferred embodiments of a connector mounting arrangement for mounting a connector on a panel, according to the present invention, will be described below.

Figure 1:
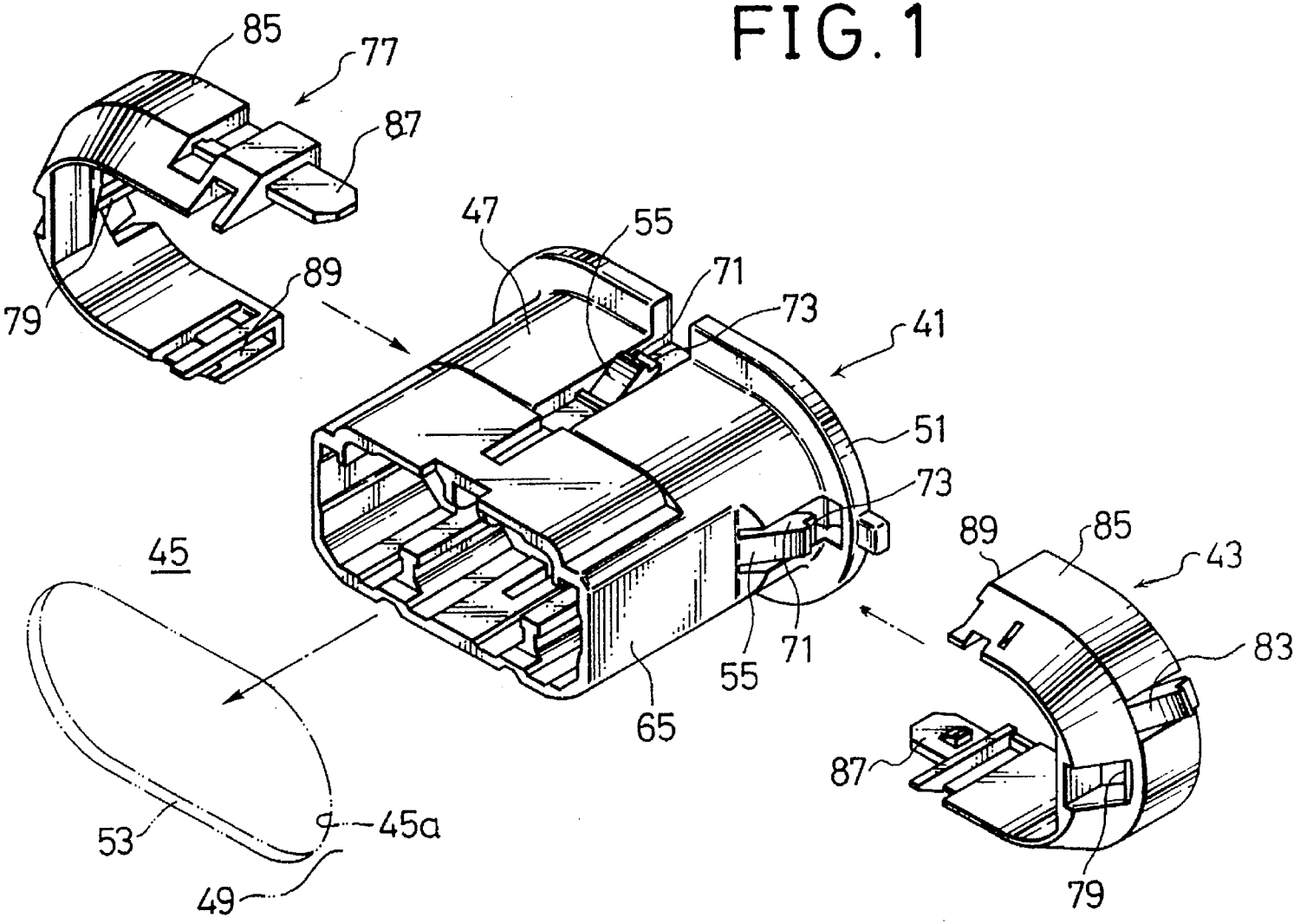
FIG. 1 is an exploded perspective view of a connector and an adapter mounted thereon, in the preferred embodiment of a connector mounting arrangement according to the present invention.
Figure 2:
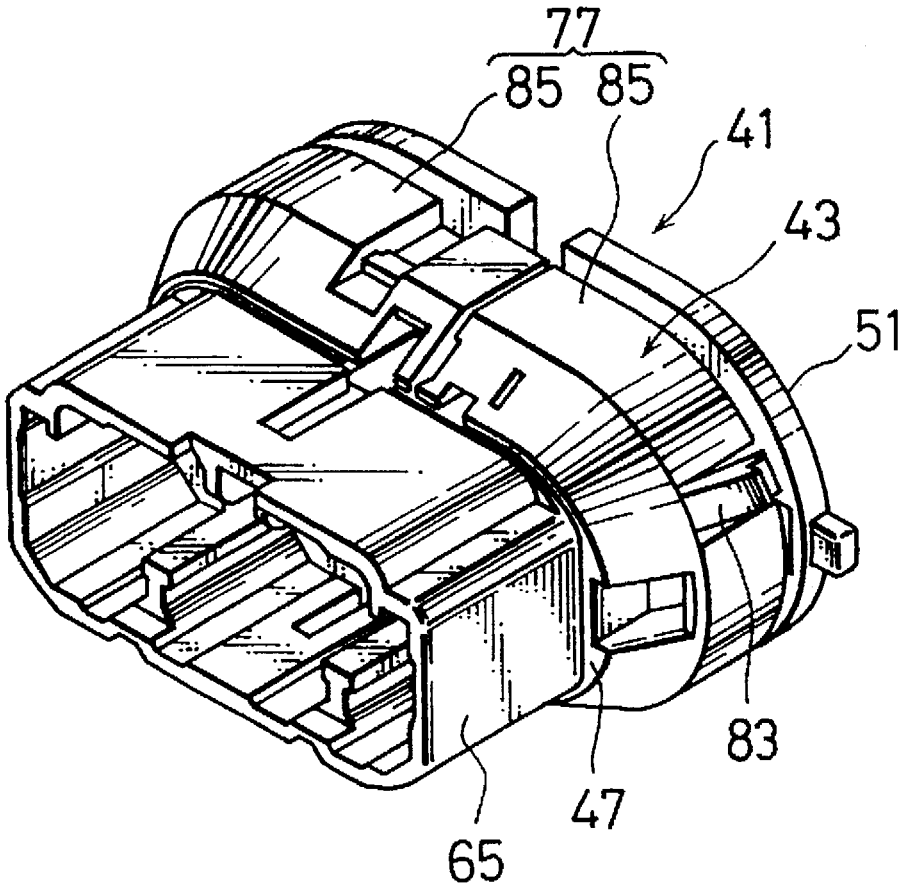
FIG. 2 is a perspective view of the adapter and the connector of FIG. 1 when the adapter is mounted on the connector.
Figure 3:
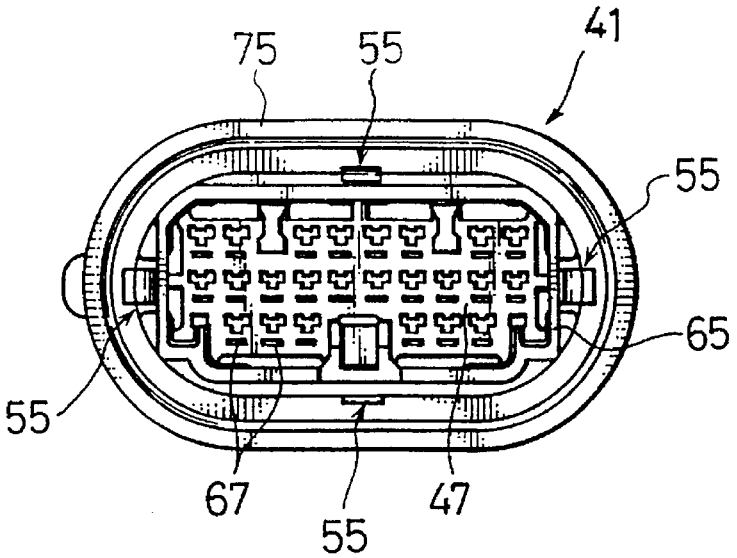
FIG. 3 is a plan view of the connector of FIG. 1, on which no adapter is mounted.
Figure 4:
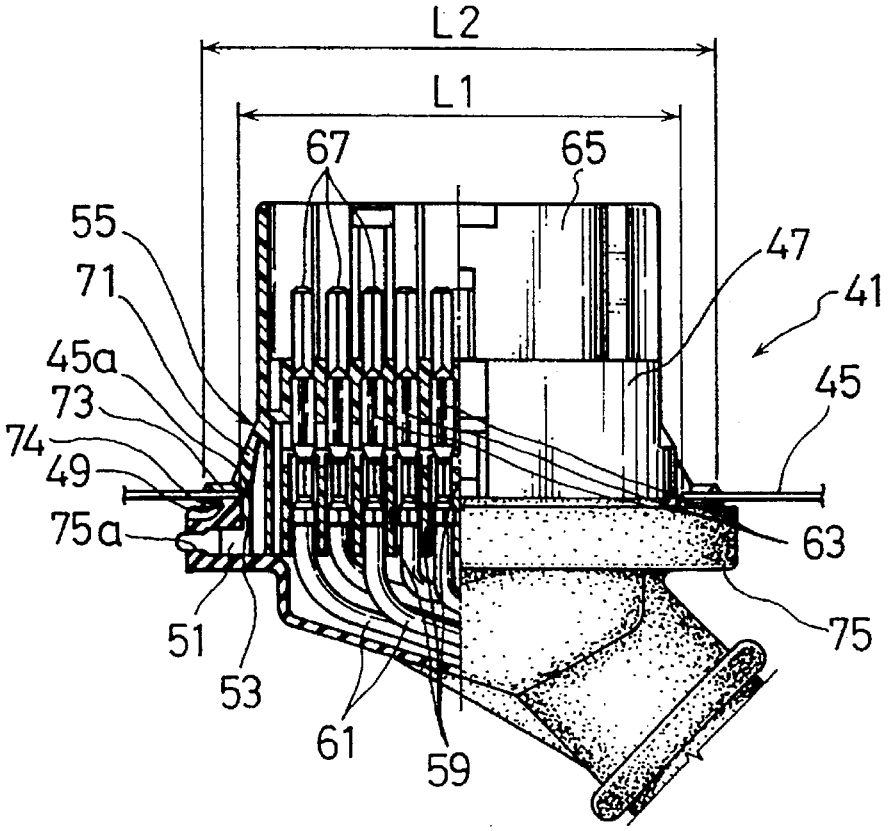
FIG. 4 is a sectional view of the connector of FIG. 3 when it is mounted in a mounting hole sized to the connector.

FIG. 1 is an exploded perspective view of a connector 41 and an adapter 43 mounted thereon, and FIG. 2 is a perspective view of the adapter 43 mounted on the connector 41. FIG. 3 is a plan view of the connector 41, on which the adapter 43 is not mounted, and FIG. 4 is a sectional view of the connector 41 of FIG. 3 when it is mounted in a mounting hole sized to the connector 41.

As shown in FIGS. 1 through 3, the connector 41 comprises a housing 47 received in a mounting hole 45*a* formed in a panel 45, a flange portion 51 provided on the peripheral portion of one end of the housing 47 for contacting an edge portion 49 surrounding the mounting hole 45*a*, a plurality of resilient engaging portions 55 integrally formed on the outer surface of the housing 47 so as to be associated with the frange portion 51 for holding an opening edge portion 53 of the mounting hole 45*a*, and a waterproof grommet 75. In the preferred embodiment, the adapter 43 is mounted on the outer periphery of the housing 47 of the connector 41 so that the housing 47 can be mounted in a large-diameter mounting hole 57 of a greater diameter than that of the mounting hole 45*a*.

The housing 47 has a substantially ellipse cross section. As shown in FIG. 4, a plurality of terminal receiving chambers 59 are formed in the housing 47 so as to be divided into three stages. A plurality of terminal fittings 63, each of which is caulked to be connected to one end of each of a plurality of electric wires 61, are housed in the corresponding terminal receiving chambers 59, respectively. On the side of the electric wires 61 drawn out of the housing 47, the flange portion 51 projects from the side wall of the housing 47. On the opposite side to the flange portion 51, the housing 47 is integrally formed with a hood portion 65. In the hood portion 65, the tip 67 of each of the terminal fittings 63 projects. The hood portion 65 is designed to engage another connector (not shown). Between the hood portion 65 and the flange portion 51, the plurality of resilient engaging portions 55 project from the housing 47. Each of the resilient engaging portions 55 comprises a resilient arm portion 71 and an engaging stepped portion 73 formed at the tip thereof.

The waterproof grommet 75 has a groove 75*a* formed therein at one end portion thereof, and a lip 74 of a frontage size L2 projecting from the outer periphery of the end surface thereof. The groove 75*a* is designed to engage the frange 51 of the connector 41. The lip 74 is designed to contact the edge portion 49 surrounding the mounting hole 45*a*.

When the housing 47 is received in the mounting hole 45*a* of a major axis L1 of the panel 45, the engaging stepped portions 73 engage the opening edge portion 53 of the mounting hole 45*a* formed in the panel 45, and the edge portion 49 surrounding the mounting hole 45*a* is held by the resilient arm portion 71 and the frange portion 51 so that the housing 47 is mounted in the mounting hole 45*a*. In this case, one end of the waterproof grommet 75 is put between the frange portion 51 and the edge portion 49 surrounding the mounting hole 45*a*, so as to prevent the entrance of water therebetween.

As shown in FIGS. 1 and 2, the adapter 43 comprises a cylindrical adapter body 77 adapted to the outer periphery of the housing 47, a plurality of engaging and mounting portions 79 provided on the inner surface of the adapter body 77 for engaging the resilient engaging portion 55 so as to mount the adapter 43 on the housing 47, and a panel engaging portion 83 provided on the outer surface of the adapter body 77 for engaging an opening edge portion 81 of the large-diameter mounting hole 57 (see FIG. 7) to be associated with the flange portion 51 for holding the opening edge portion 81 of the large-diameter mounting hole 57.

Figure 5:
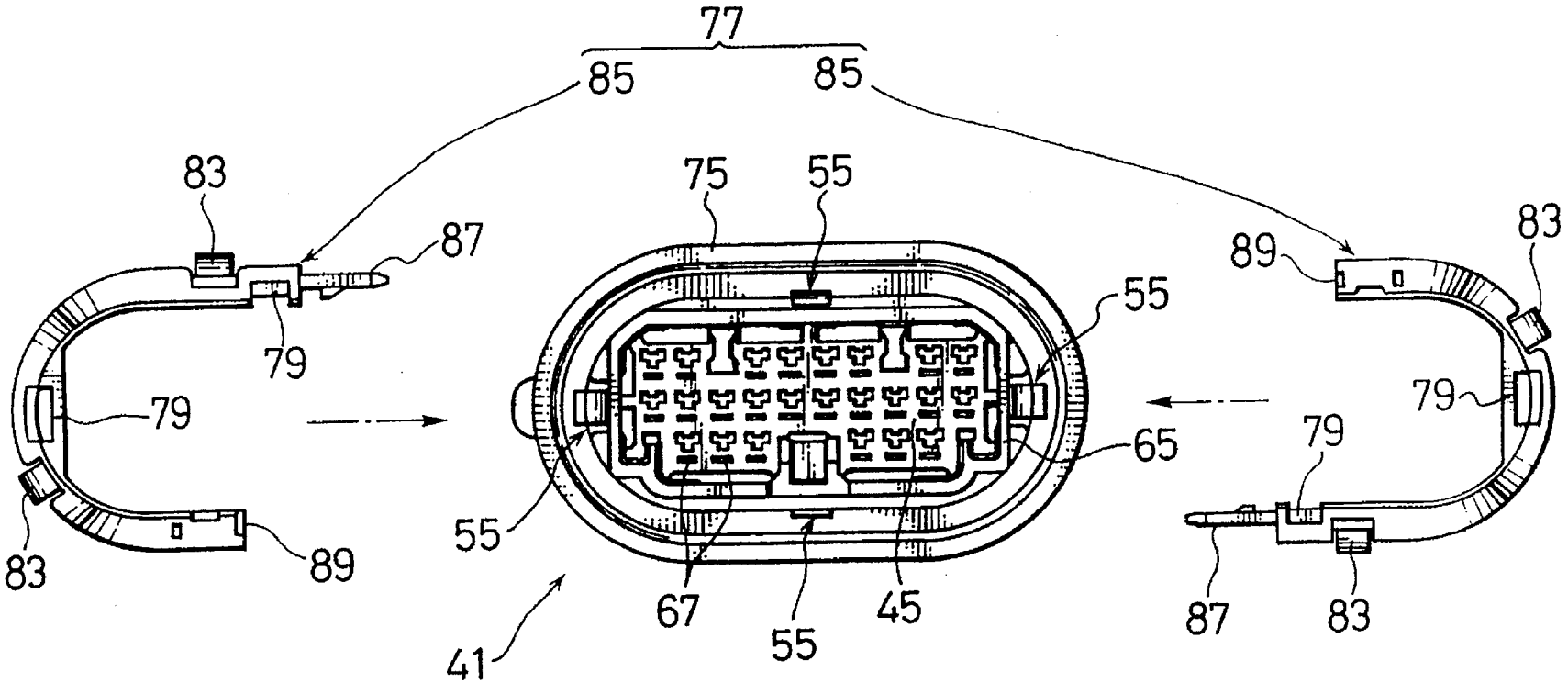
FIG. 5 is a plan view of the adapter and the connector of FIG. 1 before the adapter is mounted on the connector.

As shown in FIGS. 1 and 5, the adapter body 77 comprises a pair of substantially U-shaped half bodies 85 which are united with each other so as to form the cylindrical adapter body 77 as a whole. Each of the adapter half bodies 85 is substantially U-shaped and has the engaging and mounting portions 79 formed on the inner surface thereof at the intermediate portion and at one end thereof. In addition, at one end of each of the adapter half bodies 85, an engaging projection 87 for uniting the adapter half bodies 85 with each other is formed. At the other end of each of the half bodies 85, an engaging portion 89 which is engageable with the engaging projection 87 is formed. As can be clearly seen from FIG. 6, on the outer periphery of each of the adapter half bodies 85, panel engaging portions 83 are formed at positions offset from the engaging and mounting portions 79 in the circumferential direction of the housing 47.

Figure 6:
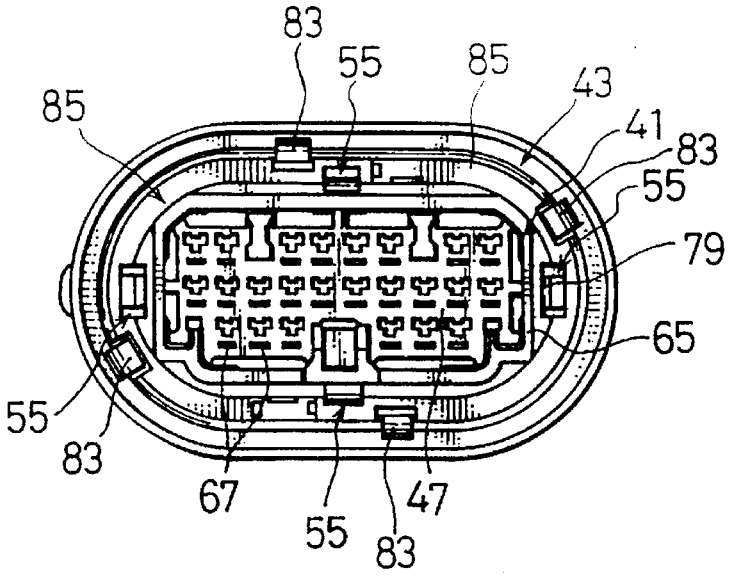
FIG. 6 is a plan view of the adapter and the connector of FIG. 1 when the adapter is mounted on the connector.

When the pair of adapter half bodies 85 are faced to each other at open ends thereof and brought into contact with the outer periphery of the housing 47 so that the engaging projections 87 engage the engaging portions 89, they are formed as a cylinder so as to be mounted on the outer periphery of the housing 47, as shown in FIGS. 2 and 6. Furthermore, the engaging portions 79 engage the resilient engaging portions 55 of the housing 47 so that the adapter 43 is mounted on the outer periphery of the housing 47.

Methods for mounting the connector 41 on the mounting hole 45*a* sized to the connector 41 and on the large-diameter mounting hole 57 of a greater diameter than that of the mounting hole 45*a* will be described below.

As shown in FIGS. 3 and 4, the flange portion 51 is first caused to engage the groove 75*a* formed in the waterproof grommet 75 so as to connect one end of the waterproof grommet 75 of the outer diameter L2 of the lip 74 to the connector 41. Then, the housing 47 is inserted into the mounting hole 45*a* of the inner diameter L1, and the resilient arm portions 71 of the resilient engaging portions 55 are inserted into the mounting hole 45*a*. At this time, when the housing 47 is pushed into the mounting hole 45*a*, the resilient arm portions 71 passing through the mounting hole 45*a* is temporarily bent toward the housing 47. After the resilient arm portions 71 passed through the mounting hole 45*a*, they move to be appart from the housing 47 by thier resilient force. Then, as shown in FIG. 4, the engaging stepped portions 73 engage the opening edge portion 53 of the mounting hole 45*a*, and the one end of the waterproof grommet 75 is tightly held between the flange portion 51 and the edge portion 49 surrounding the mounting hole 45, so that the connector 41, together with the waterproof grommet 75, is mounted in the mounting hole 45. On this condition, the portion between the edge portion 49 surrounding the mounting hole 45*a* and the flange 51 is sealed with the waterproof grommet 75.

Figure 7:
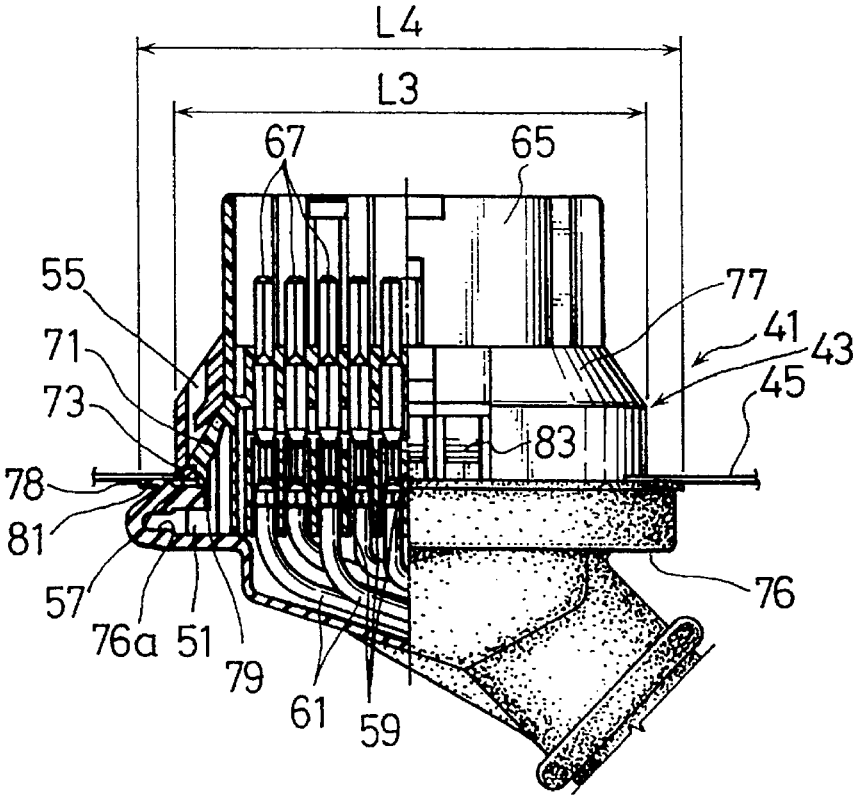
FIG. 7 is a sectional view of the connector of FIG. 6 when it is mounted in a large-diameter mounting hole of a greater diameter than that of the mounting hole sized to the connector.

In a case where the inner diameter of the mounting hole 45*a* sized to the connector 41 is changed to a large diameter such as an inner diameter L3 of the mounting hole 57 in order to mount the adapter body 77 on the connector 41, the engaging projections 87 are caused to engage the engaging portion 89 after arranging the adapter half bodies 85 on both sides of the housing 47 so that the open end portions thereof face each other, as shown in FIG. 5. Then, the engaging and mounting portions 79 engage the resilient engaging portions 55 of the housing 47, so that the adapter 43 is mounted on the outer periperal portion of the housing 47. On this condition, the outer diameter of the connector 41 is increased by the thickness of the adapter 43. In addition, as shown in FIGS. 6 and 7, the flange portion 51 is tightly inserted into a groove 76*a* of a waterproof grommet 76 of an outer diameter L4.

From this condition, the adapter 43, toghether with the housing 47, is inserted into the large-diameter mounting hole 57 so as to cause the panel engaging portions 83 to engage and hold the opening edge portion 81 of the large-diameter mounting hole 57. In this way, the connector 41 is mounted in the large-diameter mounting hole 57 while one end of the waterproof grommet 76 is put between the flange portion 51 and the opening edge portion 81 of the large-diameter mounting hole 57. On this condition, the connector 41 is tightly mounted in the large-diameter mounting hole 57, and the portion between the flange portion 51 and the peripheral portion of the large-diameter mounting hole 57 is surely sealed with the waterproof grommet 76.

The case where the connector 41 is mounted in the mounting hole 45*a* or the large-diameter mounting hole 57 has been desiribed above. To the contrary, the case where the connector 41 is mounted in the mounting hole 45*a* of a smaller diameter than that of the large-diameter mounting hole 57 from the condition that the connector 41 is mounted in the large-diameter mounting hole 57 by mounting the adapter 43 on the connector 41, will be described below. Furthermore, such a case is used when it is expected that the mounting hole of the connector is previously changed from a large-diameter mounting hole to a small-diameter mounting hole.

Figure 8:
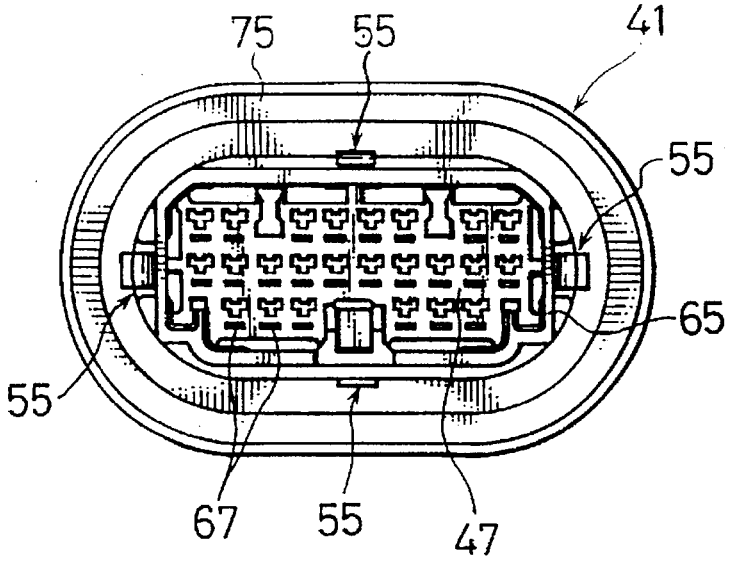
FIG. 8 is a plan view of the connector when the adapter is removed from the connector of FIG. 6.
Figure 9:
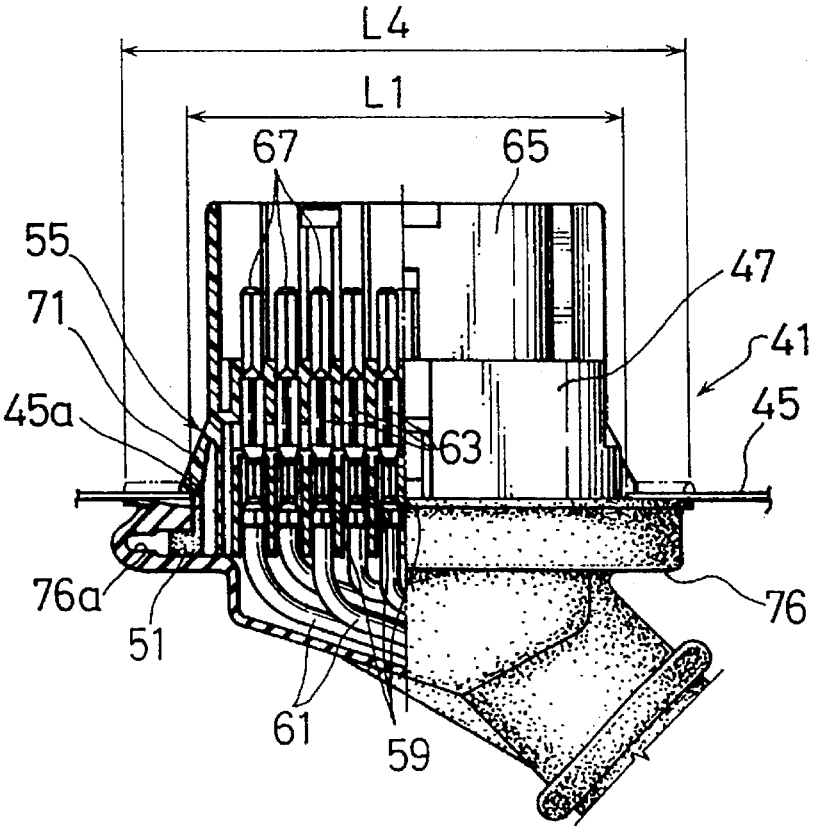
FIG. 9 is a sectional view of the connector of FIG. 8 when it is mounted in a mounting hole.

As shown in FIGS. 8 and 9, the adapter 43 is removed from the housing 47 of the connector 41. In this case, the grommet 76 remains as it is. Then, as shown in FIG. 9, the housing 47 is inserted into the mounting hole 45*a* so as to cause the resilient engaging portions 55 to engage the opening edge portion 53 of the mounting hole 45*a*. On this condition, the connector 41 is tightly mounted in the mounting hole 45*a*, and the grommet 76 is put between the flange 51 and the mounting hole 45*a* so as to surely seal the portion therebetween.

As mentioned above, according to the present invention, it is possible to mount the connector 41 in the large-diameter mounting hole 57 of a different diameter from that of the mounting hole 45*a* only by mounting the adapter 43 on the outer periphery of the housing 43. Therefore, it is possible to mount the connector 41 on the panel 45 even if the size of the mounting hole is changed. Accordingly, it is possible to prevent the same connectors as the previously used connector 41 sized to the mounting hole 45*a*, from remaining as useless stock items to make good use of the connectors, by preparing various types of adapters and waterproof grommets.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A mounting arrangement for mounting a connector on a panel, said connector having a housing capable of being received in a mounting hole which is formed in a panel and which is sized to the housing, a flange portion provided on the outer periphery of one end portion of the housing so as to be capable of facing an edge portion surrounding the mounting hole, a resilient engaging portion projecting from the outer periphery of the housing so as to be capable of being associated with the flange portion for being engageable with an opening edge portion of the mounting hole, and a waterproof grommet, one end of which is capable of being held between the flange portion and the edge portion so as to seal the portion between the flange portion and the edge portion, said mounting arrangement comprising an adapter mounted on the outer periphery of said housing for mounting said connector in a large-diameter mounting hole of a greater diameter than that of said mounting hole sized to said housing.

2. A mounting arrangment as set forth in claim 1, wherein said adapter comprises:

a cylindrical adapter body;

an engaging and mounting portion provided on the inner surface of said adapter body for engaging said resilient engaging portion to mount said adapter on said housing; and a panel engaging portion provided on the outer surface of said adapter body for engaging an opening edge portion of said large-diameter mounting hole, said panel engaging portion being associated with said flange portion for holding said opening edge portion of said large-diameter mounting hole and said one end of said waterproof grommet.

3. A mounting arrangement as set forth in claim 2, wherein said panel engaging portion is so arranged as to be offset from said engaging and mounting portion in the circumferential direction of said housing.

4. A mounting arrangement as set forth in any one of claims 1 through 3, wherein said adapter body comprises a pair of substantially U-shaped adapter half-bodies, the open ends of one of said adapter half-bodies facing the open ends of the other adapter half-body to be united with each other so as to form said cylindrical adapter body.

5. A mounting arrangment as set forth in claim 4, wherein one end of each of said adapter half-bodies is formed with an engaging projection, and the other end thereof is formed with an engaging portion so that the engaging portion of one of said adapter half-bodies is engageable with the engaging projection of the other adapter half-body.

6. A connecting apparatus mounted on a panel for connecting a wire harness to another wire harness, said connecting apparatus comprising:

a connector having:

a housing capable of being received in a mounting hole which is formed in a panel and which is sized to the housing;

a flange portion provided on the outer periphery of one end portion of the housing so as to be capable of facing an edge portion surrounding the mounting hole; and a resilient engaging portion projecting from the outer periphery of the housing so as to be capable of being associated with the flange portion for being engageable with an opening edge surrounding portion of the mounting hole, a waterproof grommet, one end of which is capable of being held between the flange portion and the edge portion so as to seal the portion between the flange portion and the edge portion; and an adapter mounted on the outer periphery of the housing for mounting the connector in a large-diameter mounting hole of a greater diameter than that of the mounting hole sized to the housing.

7. A connecting apparatus as set forth in claim 6, wherein said adapter comprises:

a cylindrical adapter body;

an engaging and mounting portion provided on the inner surface of said adapter body for engaging said resilient engaging portion to mount said adapter on said housing; and a panel engaging portion provided on the outer surface of said adapter body for engaging an opening edge portion of said large-diameter mounting hole, said panel engaging portion being associated with said flange portion for holding said opening edge portion of said large-diameter mounting hole and said one end of said waterproof grommet.

8. A connecting apparatus as set forth in claim 7, wherein said panel engaging portion is so arranged as to be offset from said engaging and mounting portion in the circumferential direction of said housing.

9. A connecting apparatus as set forth in any one of claims 6 through 8, wherein said adapter body comprises a pair of substantially U-shaped adapter half-bodies, the open ends of one of said adapter half-bodies facing the open ends of the other adapter half-body to be united with each other so as to form said cylindrical adapter body.

10. A connecting apparatus as set forth in claim 9, wherein one end of each of said adapter half-bodies is formed with an engaging projection, and the other end thereof is formed with an engaging portion so that the engaging portion of one of said adapter half-bodies is engageable with the engaging projection of the other adapter half-body.

* * * * *